US006915936B2

(12) United States Patent
Estes

(10) Patent No.: US 6,915,936 B2
(45) Date of Patent: Jul. 12, 2005

(54) TOOL FOR INSTALLING NAIL-PIN ANCHORS AND ANCHOR BOLTS

(75) Inventor: John Howard Estes, Spring, TX (US)

(73) Assignee: Matrix Tool, Inc., Spring, TX (US)

( * ) Notice: Subject to any disclaimer, the term of this patent is extended or adjusted under 35 U.S.C. 154(b) by 0 days.

(21) Appl. No.: 10/655,979

(22) Filed: Sep. 5, 2003

(65) Prior Publication Data

US 2005/0051596 A1 Mar. 10, 2005

(51) Int. Cl.[7] ..... B25C 7/00

(52) U.S. Cl. ..... 227/147; 227/139; 227/141; 227/107; 29/275

(58) Field of Search ..... 227/139, 147, 227/141, 148, 107, 119; 29/255, 275

(56) References Cited

U.S. PATENT DOCUMENTS 1,089,112 A * 3/1914 Coutant ..... 227/139
2,543,942 A * 3/1951 Shaff ..... 227/147
2,641,379 A * 6/1953 Barbaro ..... 29/402.08
3,695,499 A * 10/1972 Taylor ..... 227/52
4,171,083 A * 10/1979 Lippacher et al. ..... 227/69
4,845,827 A * 7/1989 Vandermast et al. ..... 29/280
4,867,249 A * 9/1989 Watkins, Jr. et al. ..... 173/29
4,890,779 A * 1/1990 Giannuzzi ..... 227/139
5,184,385 A * 2/1993 Valesh ..... 29/254
5,979,913 A * 11/1999 Kosik et al. ..... 279/145
6,446,318 B1 * 9/2002 Foose ..... 29/275
6,490,733 B1 12/2002 Casaubon
6,490,773 B1 * 12/2002 Estes et al. ..... 29/275

* cited by examiner

*Primary Examiner*—Louis K. Huynh
*Assistant Examiner*—Thanh Truong
(74) *Attorney, Agent, or Firm*—Mary J. Gaskin

(57) ABSTRACT

A tool for driving and setting nail-pin anchors and anchor bolts into concrete, the tool using the percussive action of a rotary hammer drill. The tool comprises a body member with a spring, a driver, and a ram inserted into the body member's bore. After a hole is drilled for insertion of the anchor, the masonry drill bit of the rotary hammer drill is slid inside the bore of the ram and temporarily locked to the tool. The rotary hammer drill is activated, and the drill bit turns inside the ram without affecting the body member or the anchor. Instead, the percussive force of the rotary hammer drill transfers its impact to the ram and the driver, which impacts the nail of the nail-pin anchor, or the stem of the anchor bolt, setting it into the concrete. A keyed bearing can be installed inside a sleeve of the ram in order to protect the tip of the masonry drill bit from shearing.

6 Claims, 7 Drawing Sheets

TOOL FOR INSTALLING NAIL-PIN ANCHORS AND ANCHOR BOLTS

FIELD OF THE INVENTION

The present invention relates to a tool for installing nail-pin anchors and anchor bolts, in connection with a rotary hammer drill with a masonry drill bit.

BACKGROUND OF THE INVENTION

Nail-pin anchors and anchor bolts (sometimes called "quick bolts") are widely used in the construction industry. A nail-pin anchor has an anchor sleeve topped by a convex-shaped crown or dome. A nail is inserted into the sleeve through a hole in the dome. A hole is drilled in the concrete or brickwork. The anchor sleeve is inserted through a mounting hole in a structural piece (or through an opening in an angle iron bracket, etc.) and manually hammered into the hole in the concrete. Finally, the nail is driven into the sleeve, forming a wedge and setting the anchor. When a concrete or masonry anchor bolt with threads is installed, the threaded bolt is manually hammered into a hole in concrete. Then a nut is threaded onto the stem of the anchor.

Presently, the tools used for driving and setting a nail-pin anchor can be inefficient and even ineffective. Typically, a series of tools must be utilized. A drill is used to make the hole in the concrete. A hammer and/or screwdriver is used to hammer the anchor sleeve into the hole so that the dome rests on the surface of the concrete. A driving tool, such as a screwdriver, chisel, or center punch, and a hammer are then used to drive in the nail and set the anchor. The tools presently used can be difficult to align in order to hammer the anchor sleeve into the hole, and they may damage the dome of the anchor, which is often made from soft metal. Having to then switch to a different tool for driving the nail requires re-alignment, wasting time and causing the installer to lose his focus. When dozens of anchors must be set, the expenditure of time can be substantial. When used to drive in the nail, the presently-available tools may cause the nail to bend to one side and can even cause the nail head to chip off. Nail-pin anchors may not be properly set, resulting in a poor result, both structurally and cosmetically. The same problem arises when an installer uses a mallet or hammer to drive in the threaded bolt of an anchor bolt, or any other kind of anchor with a shaft. If the anchor setter improperly impacts the setting end of the threaded anchor, the stem may bend, making it difficult to thread the nut onto the stem. In hard-to-reach places, the installer using presently-available tools has little room to hammer in either a nail-pin anchor or an anchor bolt; in such circumstances, the anchor is even more likely to fail.

SUMMARY OF THE INVENTION

The present invention provides a tool for installing nail-pin anchors and anchor bolts which overcomes the problems of the prior art. The tool, made of steel parts, is designed so that novices can use it. The tool is safe and comfortable to use. It eliminates the need to switch from one tool to another, thereby saving time. It completely eliminates the need to use hand-held hammers or mallets.

Using a rotary hammer drill with a masonry drill bit, the installer drills a hole in the concrete or masonry and inserts the end of a nail-pin anchor or anchor bolt into the hole. He then picks up the tool (with knurled outer surfaces to improve handing) and slides the socket end of the tool over the masonry drill bit until the tool rests against the drill's domed foundation. Then he rotates the tool a quarter of a turn (90°), temporarily locking the tool to the masonry drill bit. A spring clip can be used to provide an additional means of holding the tool onto the bit. As a result, the installer can use the tool to install anchors at any angle, including upside-down. Holding the rotary hammer drill with one hand, the installer grips the tool with the other hand and places the milled end against the anchor. The tool of the present invention can have a concave milled tip which fits over the dome of a nail-pin anchor sleeve. The installer squeezes the trigger of the drill, and the percussive force of the drill causes the tool to seat the dome of the anchor against the surface of the concrete and, simultaneously, set the nail into the sleeve. For anchors with threads, the tool will squarely impact the strike end of the stem of the threaded anchor and drive it in without bending it; the nut can then be easily threaded onto the stem.

The tool can be used without damaging the nail-pin anchors, the anchor bolts, or the surfaces of the objects being anchored. The installer is able to stay completely focused on installing each anchor. Finally, installation of each anchor takes considerably less time than does the process using presently-available tools.

It is an object of the present invention to provide a tool which is safe and comfortable to use.

Another object of the present invention is to provide a tool which is easy to use, regardless of an installer's experience.

Still another object of the present invention is to provide a tool which allows the installer to install nail-pin anchors and anchor bolts, using focused, efficient movements.

Yet another object of the present invention is to provide a tool which shortens the amount of time required to install each anchor.

A further object of the present invention is to provide a tool which fits over the drill bit of a rotary hammer drill, and which uses the percussive force of the drill and the tool's spring action to drive anchors into concrete or masonry.

A still further object of the present invention is to provide a tool which can be used without damaging either the anchors or the surfaces of the material to be anchored (often made from metal).

DESCRIPTION OF THE PREFERRED EMBODIMENT

Figure 1:
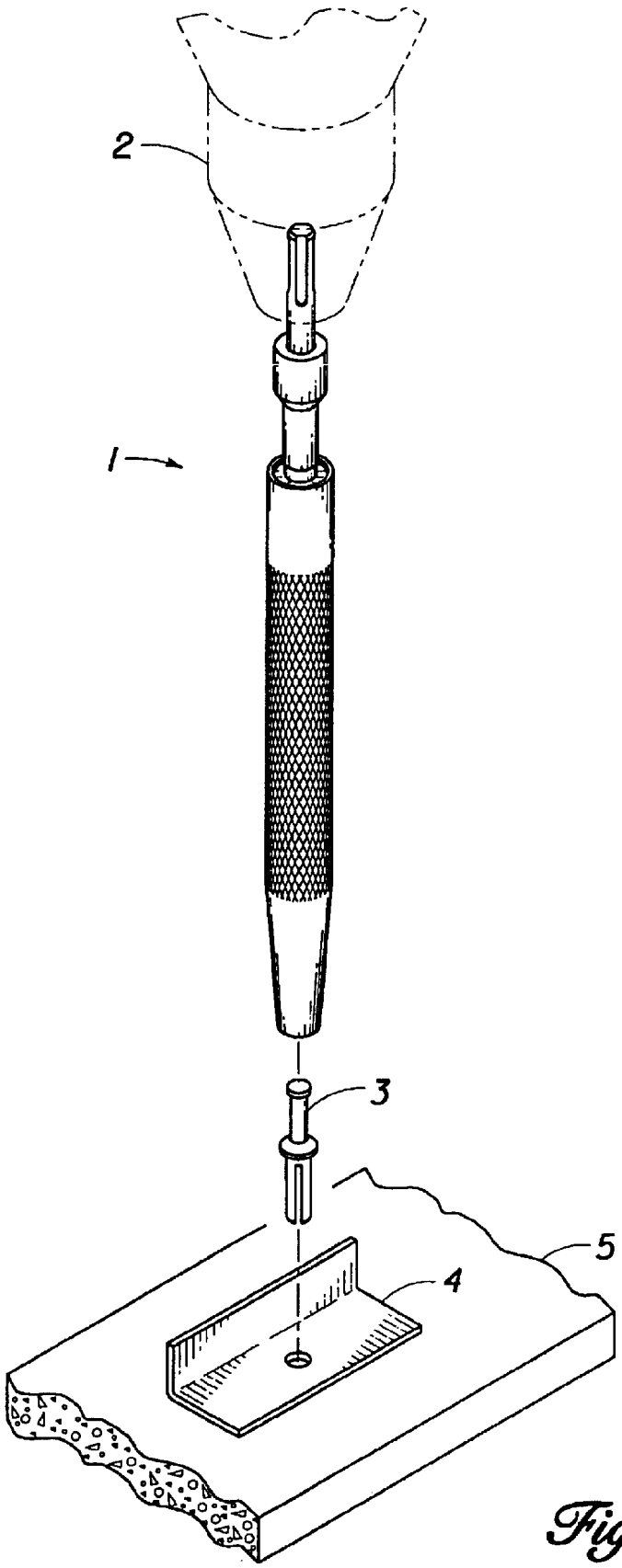
FIG. 1 is a front perspective view of the tool of the present invention, which has been installed onto a masonry drill bit of a rotary hammer drill; it is aligned with a nail-pin anchor, before anchoring an angle iron bracket to a concrete block.

As shown in FIG. 1, the anchor setting tool 1 of the present invention is used with a rotary hammer drill 2 to drive a nail-pin anchor 3 through a hole in an angle iron bracket 4 and into a drilled hole in a concrete block 5 and set it.

Figure 2:
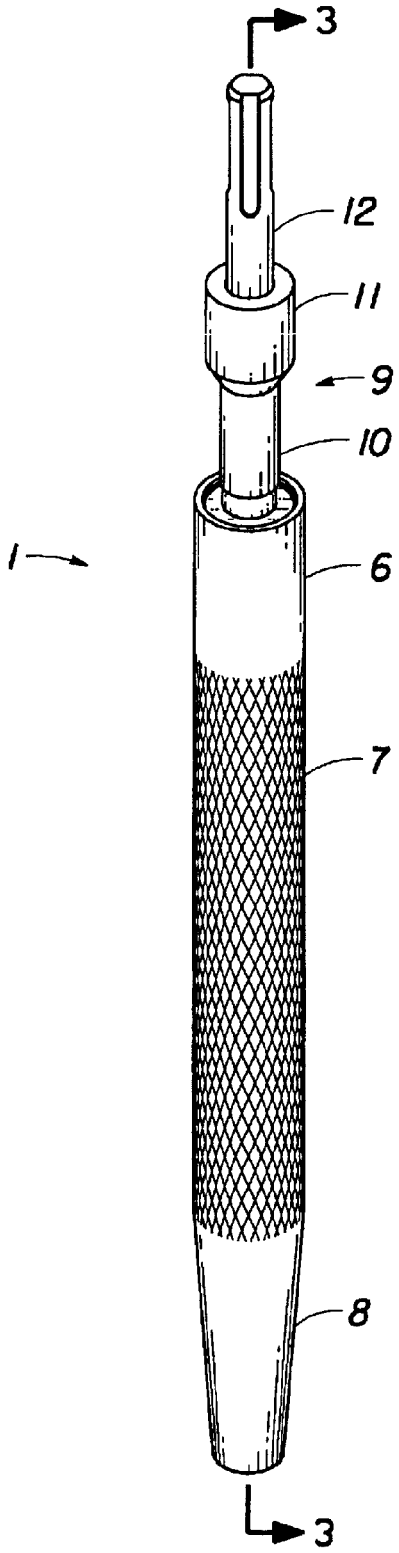
FIG. 2 is an enlarged front perspective view of the assembled tool of the present invention.

FIG. 2 shows the assembled anchor setting tool 1. The body 6, which serves as the hand grip, is made from a hard metal such as 1 inch Barstock grade metal (such as 4140). The body 6 has knurls 7 on its surface to prevent slippage of the tool 1, as well as a tapered end 8, so that the tool 1 can be used to set anchors in a tight area, such as a channel. Inserted into the upper end of the body 1 is a ram 9 having a stem 10 and a socket end 11, into which has been inserted a masonry drill bit 12.

Figure 3:
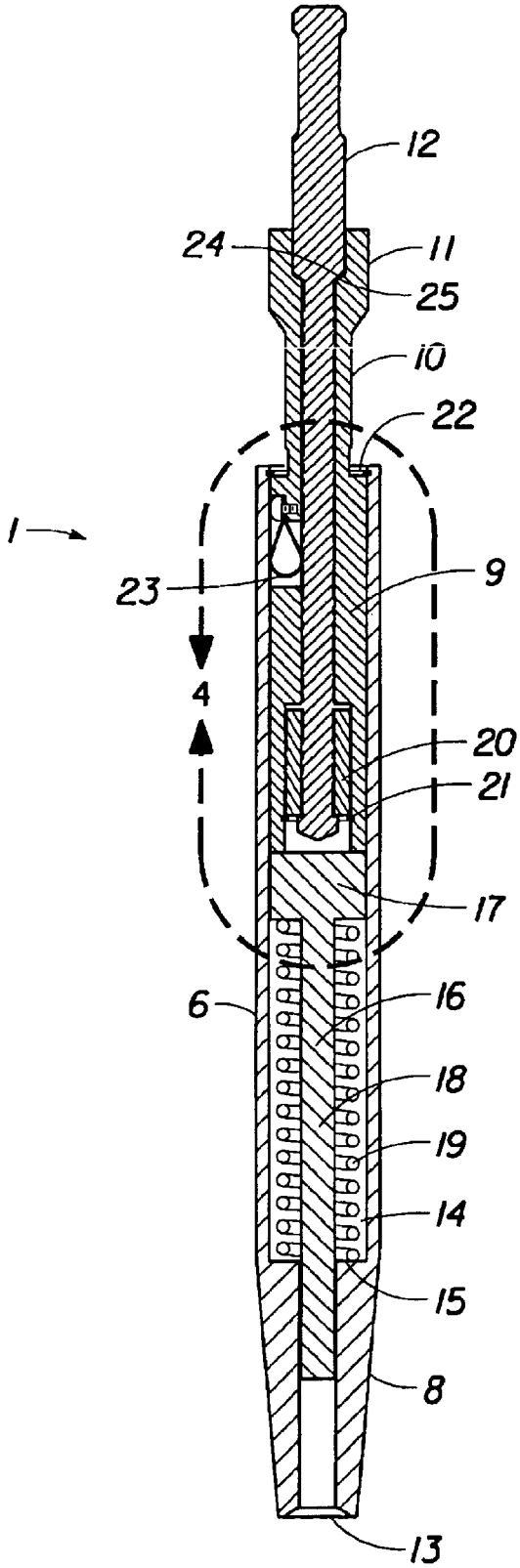
FIG. 3 is a sectional side plan view of the tool shown in FIG. 2 taken along line 2—2.

The sectional view in FIG. 3 shows the elements cooperating inside the body 6 of the tool 1. The tapered end 8 optionally can be milled with a concave tip 13 to fit over the dome of a nail-pin anchor or rivet. Alternatively, the tip 13 can be flat (not shown). In either case, the length of the nail or stem of an anchor fits into the opening at the tip 13 of the body 6. The internal cylinder 14 of the body 6 has been milled and machined to have an internal base 15, upon which an end of the steel-wire spring 19 rests. The stem 18 of the driver 16 has been inserted into the spring 19, and the base 17 of the driver 16 acts as the final foundation for the spring 19. Resting against the base 17 of the driver 16 is the lower end of the ram 9, which has been milled and machined to have the same outer diameter as that of the base 17 of the driver 16. Both the ram 9 and the driver 16 are designed to slide back and forth within the body 6 of the tool 1; they will move up and down with the percussive action of the rotary hammer drill 2. Within a cylindrical opening inside ram 9 is a keyed bearing 20, which is held in place by a spring steel snap ring 21. The ram 9 itself, as well as the driver 16 and the spring 19, is held inside the body 6 by spring steel snap ring 22. A "window" opening, machined on one side of the ram 9 accommodates a spring steel clip 23, which presses against the masonry drill bit 12 which has been inserted into the socket end 11 of the ram 9, through the stem 10, and into the keyed bearing 20. The clip's 23 moderate pressure on the masonry drill bit 12 provides additional means of securing the tool 1 to the masonry drill bit 12. The socket end 11 of the ram 9 has been machined and drilled to the depth required so that the bullnose foundation 24 of the masonry drill bit 12 can rest on its internal shoulder 25. When the masonry drill bit 12 turns, it rotates freely within the socket end 11, the ram 9, and the keyed bearing 20; only the keyed bearing 20 can turn with it (acting like a rotor), so that the body 6 of the tool 1 remains stationary in the installer's hand while an anchor is being installed.

Figure 4:
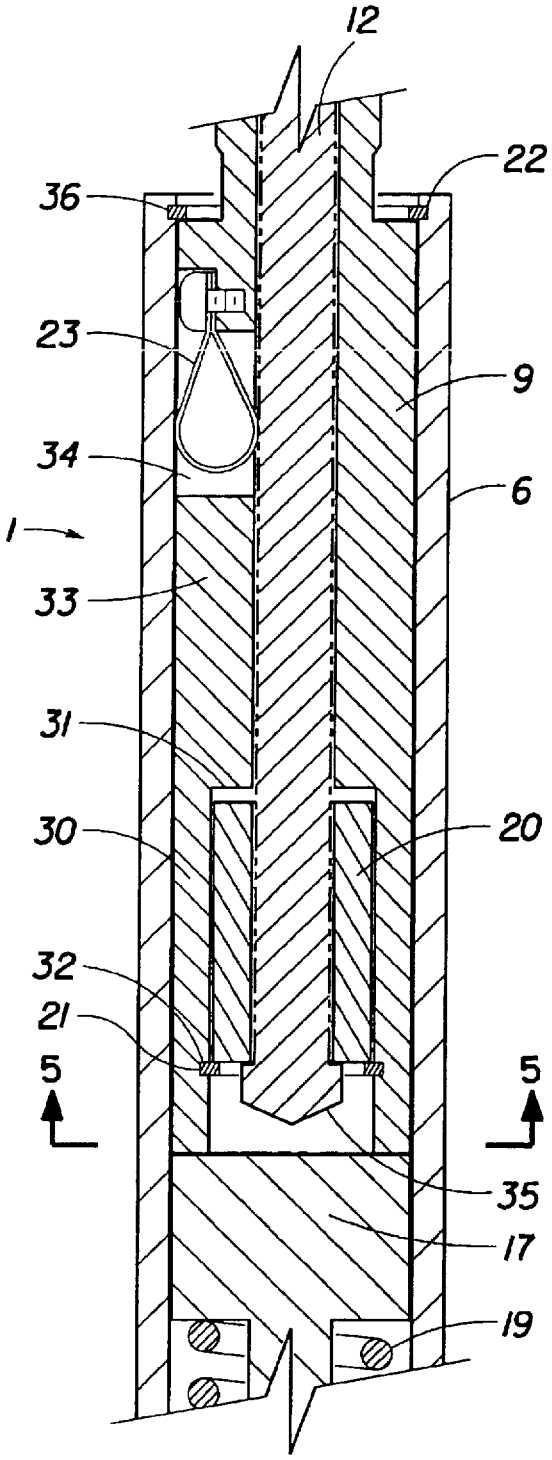
FIG. 4 is an enlarged sectional view of the midportion of the tool shown in FIG. 3.

FIG. 4 shows the midportion of the body 6 of the tool 1 in greater detail. The snap ring 21, which holds the keyed bearing 20 in place, fits into a groove 32 milled inside the cylindrical sleeve 30 of the ram 9. The keyed bearing 20 fits under internal base foundation 31 of the cylinder 33 of the ram 9. Inside the window 34 in the cylinder 33 is the clip 23. Snap ring 22 fits into a groove 36 inside the body 6, holding the ram 9 in place. The winged tip 35 of the masonry drill bit 12 has been inserted into the keyed bearing 20 inside the ram 9. The keyed bearing 20 allows the masonry drill bit 12 to spin freely within the ram 9, eliminating the possibility of shearing of the winged tip 35.

Figure 5:
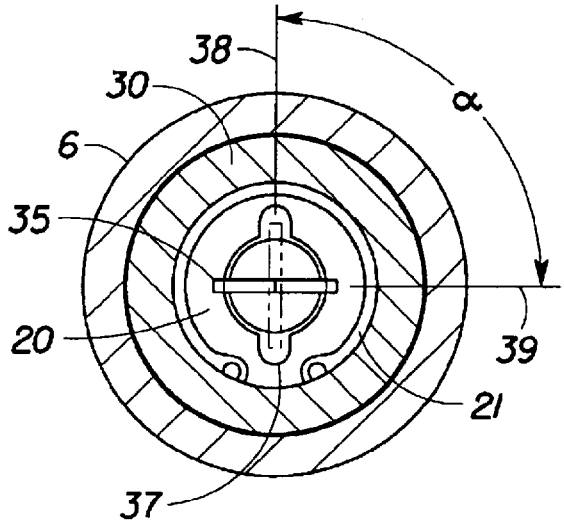
FIG. 5 is a sectional view of the tool illustrated in FIG. 4 taken along line 5—5.

The sectional view in FIG. 5 shows the slot 37 in the keyed bearing 20, which allows the keyed bearing 20 to act as a temporary lock for the winged tip 35 of the masonry drill bit (12). The snap ring 21 holds the keyed bearing 20 inside the sleeve 30 of the ram 9, which is disposed inside the body 6. The ends of the slot 37 in the keyed bearing 20 accommodate the winged tip 35, which is slid down to the bottom of the keyed bearing 20, past the snap ring 21. The body 6 is then turned ninety degrees (90°), from the unlocked position 38 to the locked position 39. Locking the masonry drill bit keeps the tool from falling off the drill bit.

Figure 6:
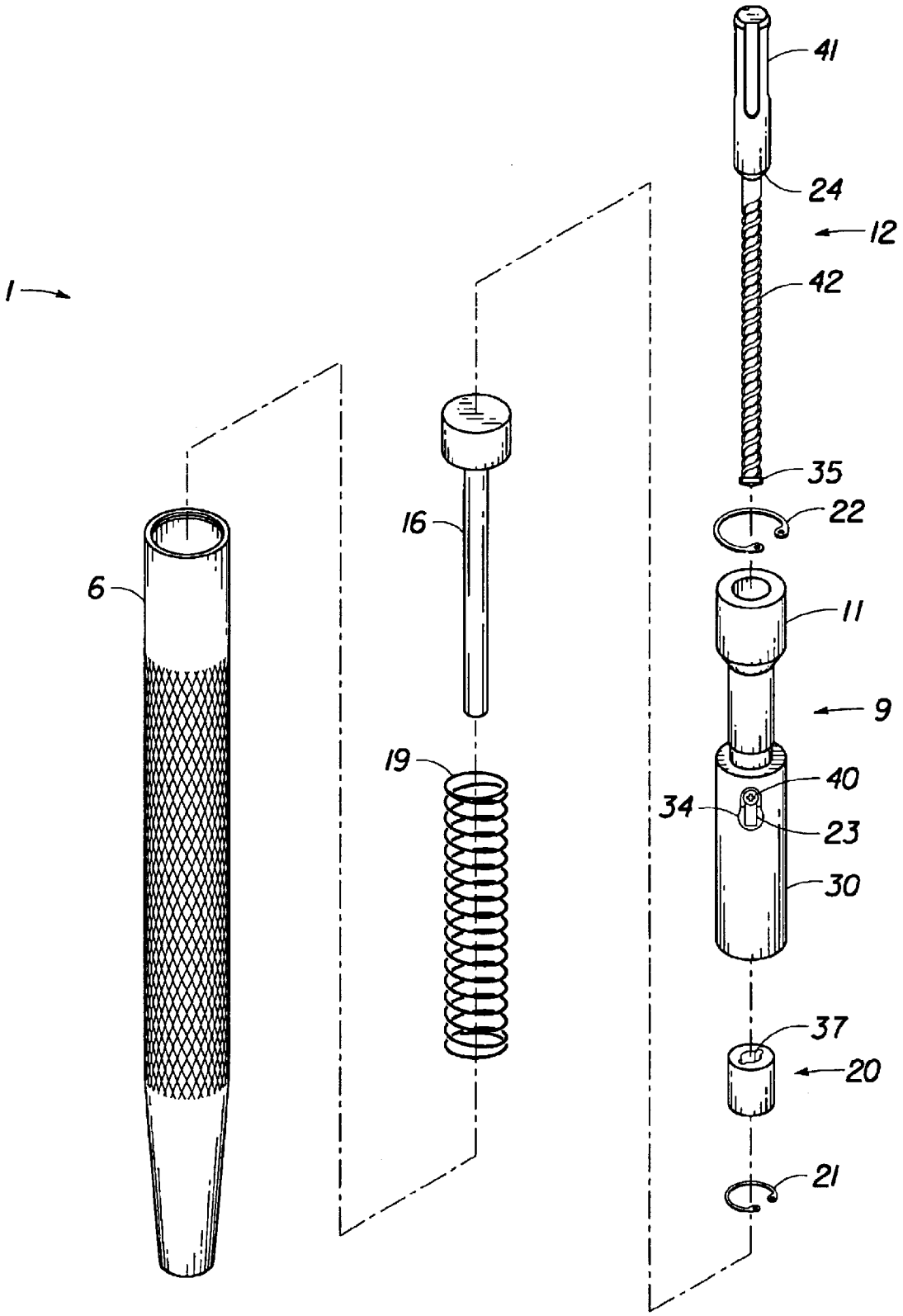
FIG. 6 is an exploded view of the tool of the present invention, showing the parts of the tool and the order of its assembly.

The exploded view in FIG. 6 shows the parts of the tool 1 prior to assembly. All parts of the tool 1 are made from steel. The spring 19 slips inside the body 6, and the driver 16 is inserted inside the spring 19. The slot 37 in the keyed bearing 20, which accommodates the winged tip 35 of the masonry drill bit 12, can be more easily seen. The keyed bearing 20 fits inside the sleeve 30 of the ram 9, with the snap ring 21 holding it in place. Inside the window 34 is the spring clip 23, which is held in place by a threaded screw 40. The ram 9 is inserted into the body 6 of the tool 1, and the snap ring 22 fitted inside the groove inside the body 6 to hold the ram 9 in place. The stem 42 of the masonry drill bit 12 is inserted into the socket end 11 of the ram 9 until the bullnose foundation 24 of the drill bit rests against the internal shoulder (25) of the socket end 11, with the winged tip 37 of the masonry drill bit 12 extending past the lower opening of the slot 37 in the keyed bearing 20, at which point the installer can turn the body 6 of the tool 1 ninety degrees (90°) to temporarily lock the tool 1 onto the masonry drill bit 12. The splined end 41 of the masonry drill bit 12 locks inside the end of a rotary hammer drill 2, which acts with the tool 1 as an anchor setter.

FIGS. 7A through 7D show sectional plan views of the tool 1 in use in the installation of an nail-pin anchor 3.

Figures 7A, 7B, 7C, 7D:
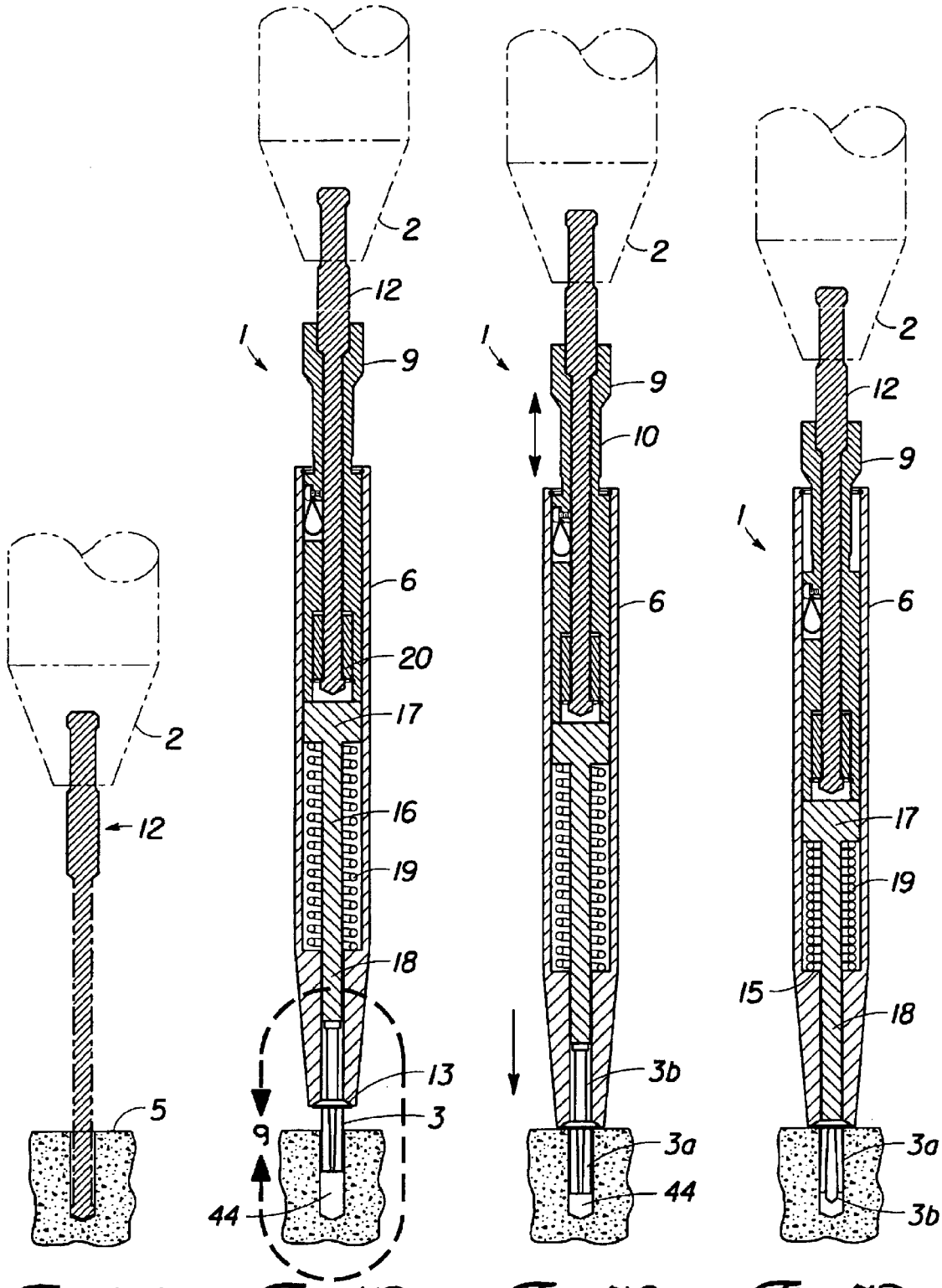
FIGS. 7A–7D are sectional side plan views of the tool of the present invention as it is used with the rotary hammer to install a nail-pin anchor.

In FIG. 7A, a rotary hammer drill 2 with a masonry drill bit 12 is used to drill a hole in a piece of concrete 5 to the depth required to install a particular nail-pin anchor.

As shown in FIG. 7B, the masonry drill bit 12 has been pulled out of the hole 44 and inserted into the body of the tool 1, passing through the keyed bearing 20 inside the ram 9, and has been temporarily locked in place (as described supra). A nail-pin anchor 3 with a convex dome has been inserted into the hole 44, under the concave tip 13 of the tool 1. The ram 9 rests against the base 17 of the driver 16, the stem 18 of which has been inserted into spring 19.

As shown in FIG. 7C, the hammering action of the rotary hammer drill 2 against the ram 9, which slides up and down inside the body 6 of the tool 1, has caused the sleeve 3*a* of the anchor to be driven into the hole 44, leaving nail 3*b*. The percussive action of the rotary hammer drill 2 can be seen with the up and down movement of the stem 10 of the ram 9.

As shown in FIG. 7D, almost simultaneously with the action shown in FIG. 7C, the hammering action of the rotary hammer drill 2 has moved the ram 9 to force the driver stem 18 to act like a hammer, with the driver base 17 compressing the spring 19 against the internal base 15. As a result, the driver stem 18 drives the nail 3*b* into the anchor sleeve 3*a*, completing installation of the nail-pin anchor 3. Releasing the trigger of the rotary hammer drill 2 allows the spring 19 to expand back to its original position. In order to remove the tool 1 from the masonry drill bit 12, the installer simply turns the body 6 of the tool 1 ninety degrees (90°) and slides the tool 1 off of the masonry drill bit 12.

FIGS. 8A through 8D show sectional plan views of the tool 1 in use in the installation of a concrete or masonry anchor bolt 45.

Figures 8A, 8B, 8C, 8D:
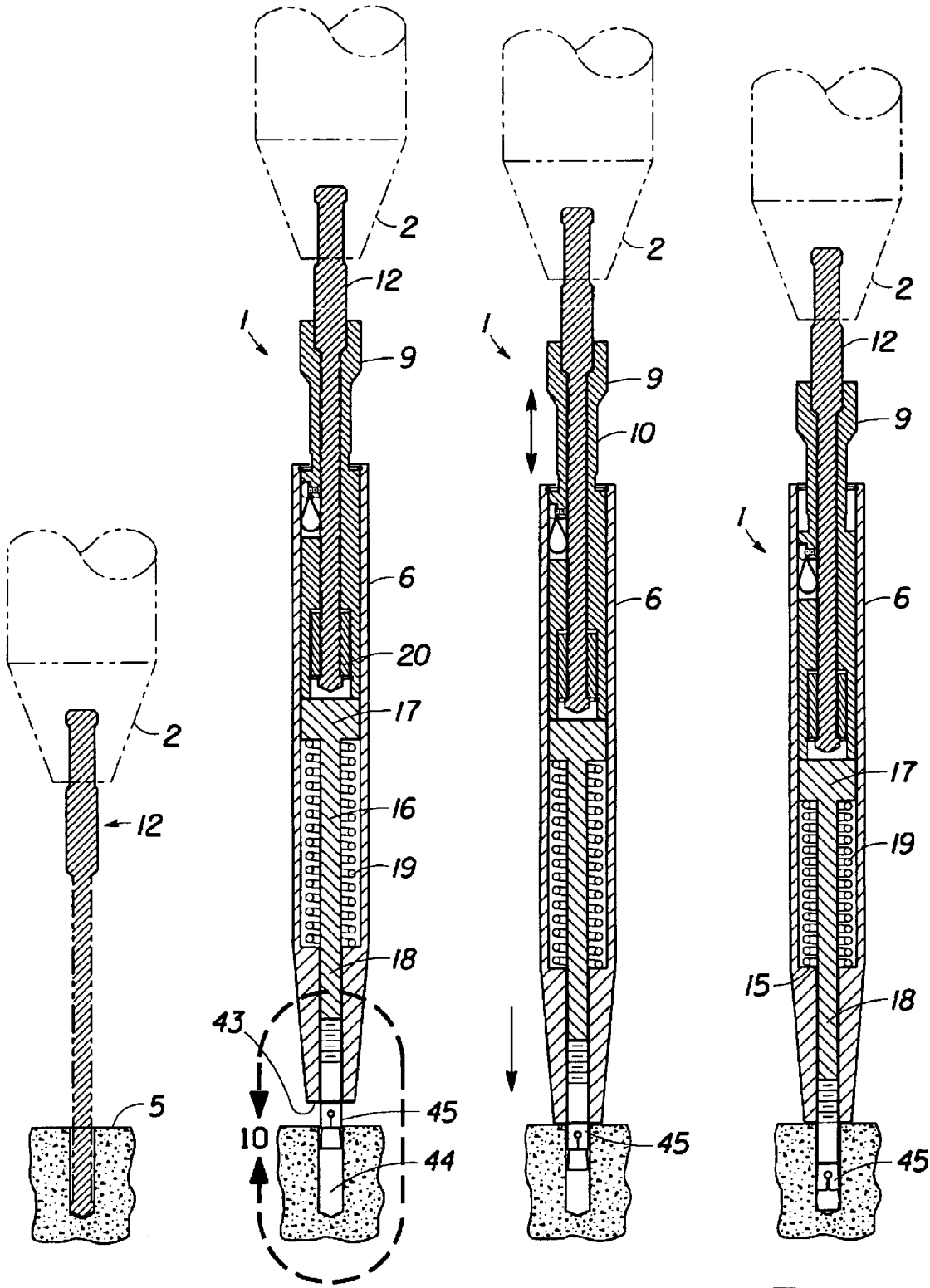
FIGS. 8A–8D are sectional side plan views of the tool of the present invention as it is used with a rotary hammer to install an anchor bolt.

In FIG. 8A, a rotary hammer drill 2 with a masonry drill bit 12 is used to drill a hole in a piece of concrete 5 to the depth required to install a particular anchor bolt.

As shown in FIG. 8B, the masonry drill bit 12 has been pulled out of the hole 44 and inserted into the body of the tool 1, passing through the keyed bearing 20 inside the ram 9, and has been temporarily locked in place (as described supra). An anchor bolt 45 has been inserted into the hole 44, with its upper end inside the flat tip 43 of the tool 1. The ram 9 rests against the base 17 of the driver 16, the stem 18 of which is has been inserted into spring 19.

As shown in FIG. 8C, the hammering action of the rotary hammer drill 2 against the ram 9, which slides up and down inside the body 6 of the tool 1, is beginning to cause the anchor bolt 45 to be driven into the hole 44. The percussive action of the rotary hammer drill 2 can be seen with the up and down movement of the stem 10 of the ram 9.

As shown in FIG. 8D, the hammering action of the rotary hammer drill 2 has moved the ram 9 to force the driver stem 18 to act like a hammer, with the driver base 17 compressing the spring 19 against the internal base 15. As a result, the driver stem 18 squarely impacts the strike end of the stem of the anchor bolt 45 and drives it into the hole 44. Releasing the trigger of the rotary hammer drill 2 allows the spring 19 to expand back to its original position. In order to remove the tool 1 from the masonry drill bit 12, the installer simply turns the body 6 of the tool 1 ninety degrees (90°) and slides the tool 1 off of the masonry drill bit 12.

Figure 9:
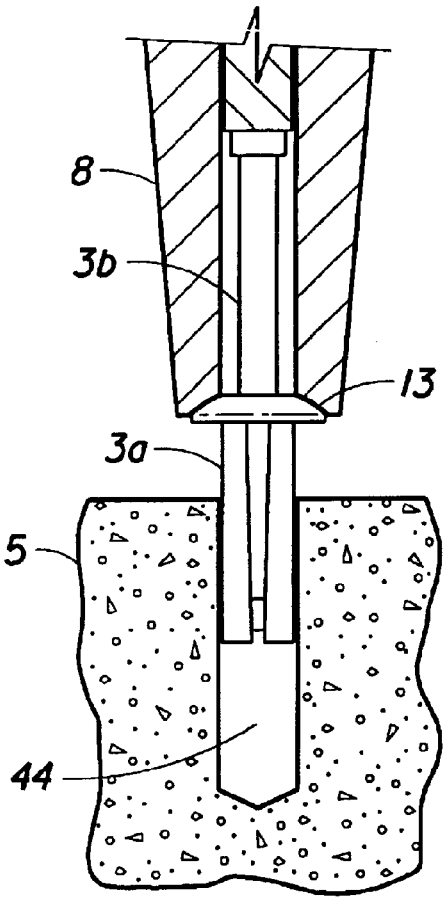
FIG. 9 is a detail of the nail-pin anchor in FIG. 7B.

As the detail drawing shows in FIG. 9, prior to its installation, the lower part of the anchor sleeve 3*a* has been inserted into the hole 44 in the piece of concrete 5, with its dome resting against the concave tip 13 of the tapered end 8 of the tool 1, and the nail 3*b* inside the opening of the tool 1.

Figure 10:
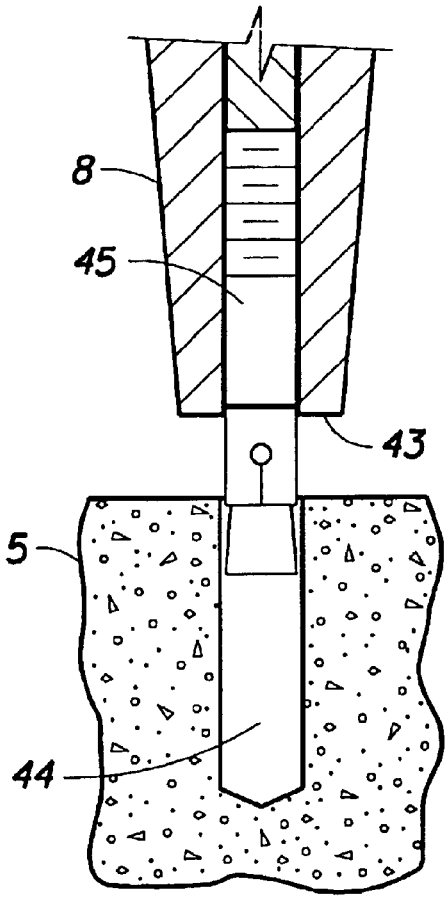
FIG. 10 is a detail of the anchor bolt in FIG. 8B.

As the detail drawing shows in FIG. 10, prior to its installation, the lower end of the anchor bolt 45 has been inserted into the hole 44 in the piece of concrete 5, with the upper end of the anchor bolt 45 having been inserted into the opening at the flat tip 43 of the tapered end 8 of the tool 1.

I claim:

1. A tool for use with a rotary hammer drill having a masonry drill bit with a splined end, a bullnose foundation, and a stem, the tool being used to install nail-pin anchors having nails and sleeves and anchor bolts having stems into concrete, the tool comprising:

an elongated cylindrical body member having a bore, a first tapered end, and a second end, the body member further having an internal foundation on the bore near the tapered end;

a spring sized to fit inside the bore of the body member, the spring having an end stopped by the internal foundation on the bore of the body member;

a driver having a nailing end and an impact end, the nailing end of the driver being inserted through the second end of the body member into the bore, inside the spring disposed therein, in axial alignment;

a ram having a bore, the ram further having a driving end and a socket end, the socket end having an internal shoulder, the driving end of the ram being inserted through the second end of the body member into the bore, in axial alignment, the driving end of the ram resting against the impact end of the driver, the ram still further having a sleeve at the driving end of the ram;

a keyed bearing having a longitudinal slot, the keyed bearing being axially disposed inside the sleeve of the ram and held therein;

means for holding the ram in place inside the bore of the body member;

means for temporarily locking the tool to the masonry drill bit, the stem of the masonry drill bit having been inserted into the bore of the ram, the bullnose foundation of the masonry drill bit resting against the internal shoulder of the socket end of the ram;

the rotary hammer drill, upon activation, imparting percussive force to the socket end of the ram, which impacts the driver, which impacts the nail-pins and sleeves of the nail-pin anchors and the stems of the anchor bolts, without impacting the body member of the tool.

2. The tool of claim 1 wherein the stem of the masonry drill bit terminates with a winged tip, the winged tip having been slid through the slot in the keyed bearing until it extends out therefrom, then turned ninety degrees (90°).

3. The tool of claim 1 wherein the means for holding the ram in place inside the bore of the body member comprises a snap ring expandibly fit into a groove in the bore of the body member.

4. The tool of claim 1 wherein the ram further has a sidewall opening and wherein a supplementary means for temporarily locking the tool to the masonry drill bit comprises a spring clip having an end attached to the ram, the spring clip being disposed to press against the stem of the masonry drill bit, through the sidewall opening in the ram.

5. The tool of claim 1, wherein the tapered open end of the body member terminates in a tip, the tip having been machined to have an inner concave shape.

6. The tool of claim 1, wherein the body member has an outer surface with knurls machined therein.

* * * * *